US005492487A

United States Patent [19]

Cairns et al.

[11] Patent Number: 5,492,487

[45] Date of Patent: Feb. 20, 1996

[54] SEAL RETENTION FOR AN ELECTRICAL CONNECTOR ASSEMBLY

[75] Inventors: Thomas M. Cairns, Beverly Hills, Mich.; William N. Moroney, Fairfield Glade, Tenn.

[73] Assignee: Ford Motor Company, Dearborn, Mich.

[21] Appl. No.: 295,183

[22] Filed: Aug. 24, 1994

Related U.S. Application Data

[63] Continuation of Ser. No. 71,889, Jun. 7, 1993, abandoned.

[51] Int. Cl.[6] ..... H01R 13/52

[52] U.S. Cl. ..... 439/273; 439/271

[58] Field of Search ..... 439/271–283

[56] References Cited

U.S. PATENT DOCUMENTS

| | | | |
|---|---|---|---|
| 4,421,373 | 12/1983 | Ratchford et al. | 439/271 |
| 4,621,883 | 11/1986 | Noguchi . | |
| 4,637,674 | 1/1987 | Kobler . | |
| 4,797,116 | 1/1989 | Isohata et al. | 439/274 |
| 4,826,452 | 5/1989 | Sian et al. . | |
| 4,874,325 | 10/1989 | Bensing et al. . | |
| 4,936,791 | 6/1990 | Zielinski et al. . | |
| 4,940,420 | 7/1990 | Munie . | |
| 4,986,758 | 1/1991 | Wakata . | |
| 4,998,896 | 3/1991 | Lundergan | 439/274 |
| 5,104,253 | 4/1992 | Zielinski et al. . | |
| 5,108,303 | 4/1992 | Maeda et al. | 439/271 |
| 5,114,359 | 5/1992 | Chishima et al. . | |
| 5,197,893 | 3/1993 | Nagamine | 439/271 |

FOREIGN PATENT DOCUMENTS

| | | |
|---|---|---|
| 5-65996 | 9/1993 | Japan . |

*Primary Examiner*—David L. Pirlot
*Attorney, Agent, or Firm*—Mark L. Mollon; Roger L. May

[57] ABSTRACT

An electrical connector assembly including a first connector member, a second connector member, a seal disposed between the first and second connector members for sealing a joint between the first and second connector members, and a sleeve cooperating with one of the first and second connector members to form a cavity for entrapping and positively retaining the seal.

18 Claims, 3 Drawing Sheets

FIG 3
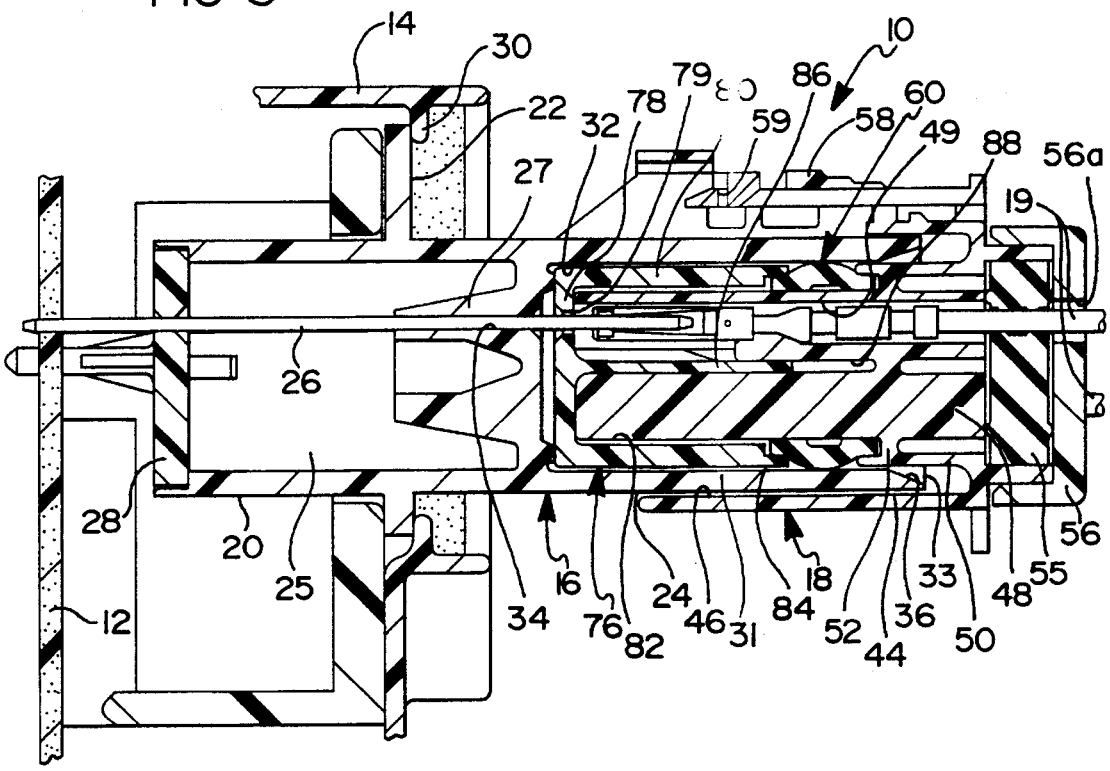
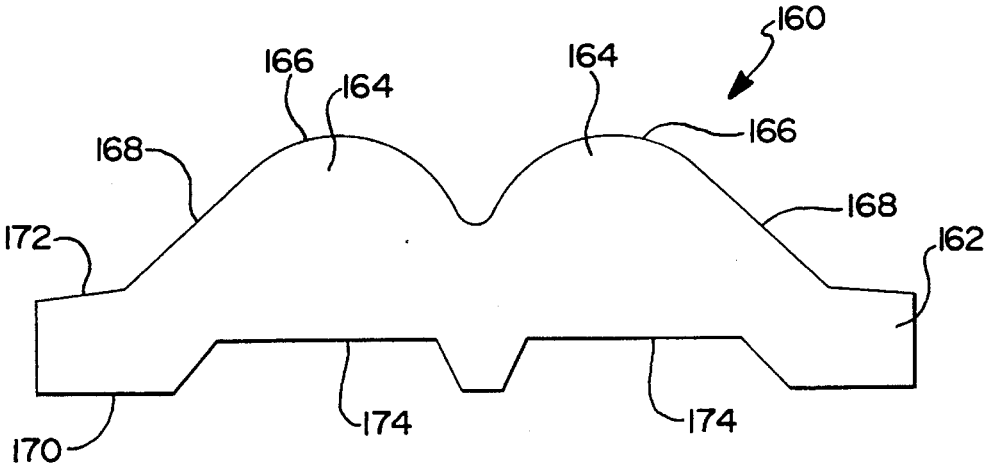
FIG 7

FIG 4
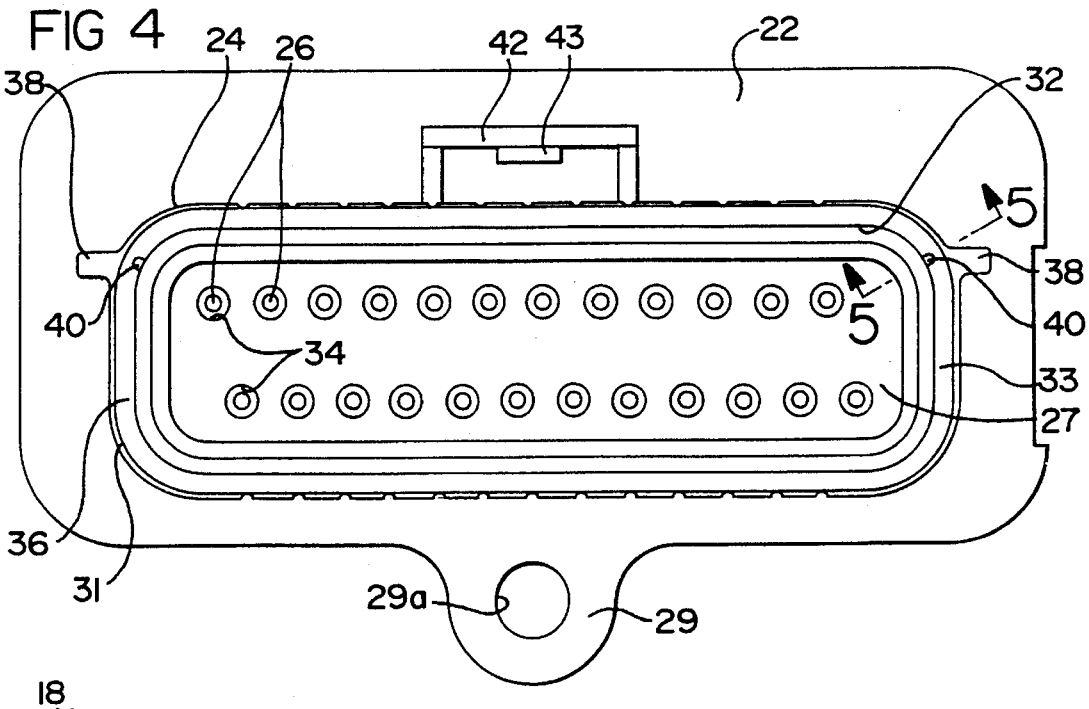
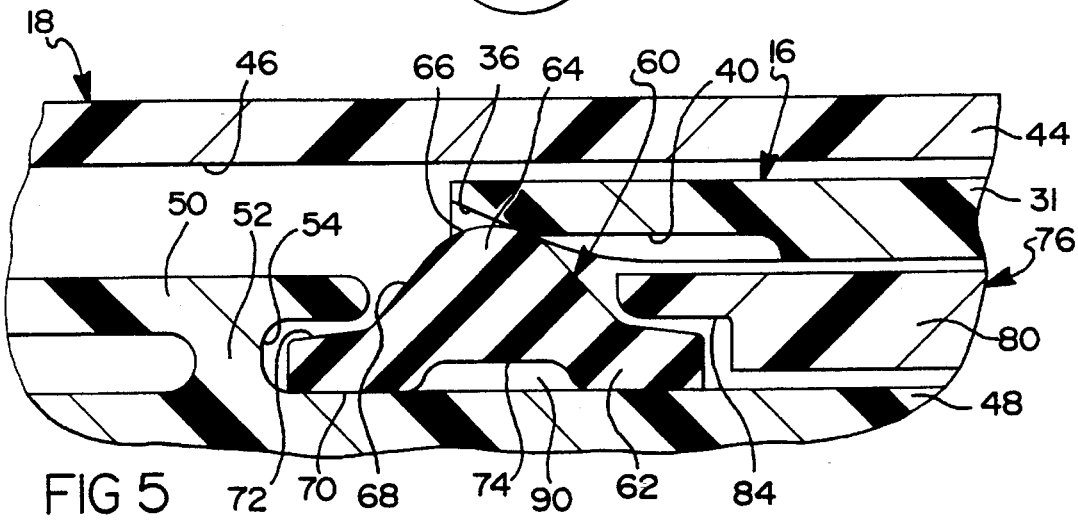
FIG 5
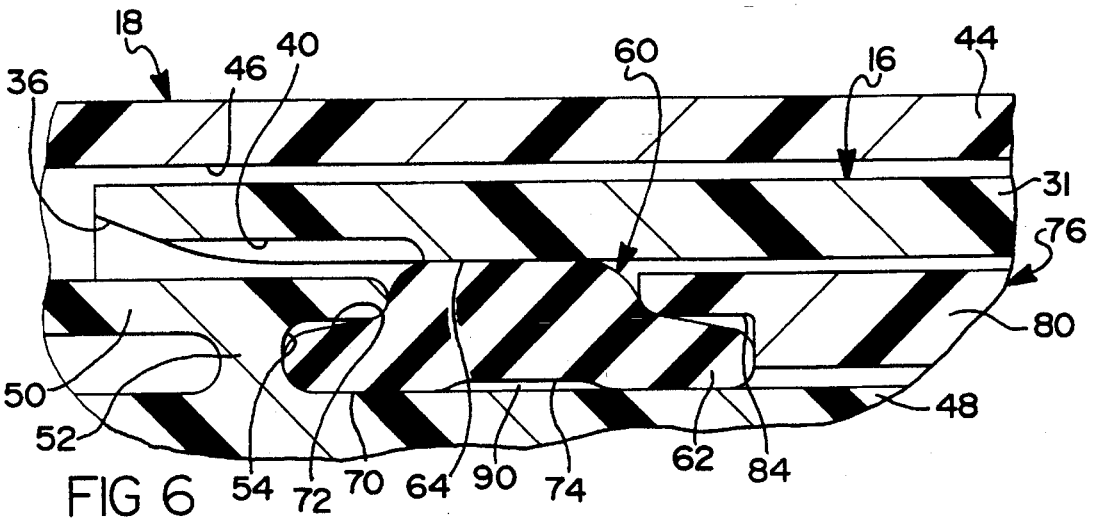
FIG 6

SEAL RETENTION FOR AN ELECTRICAL CONNECTOR ASSEMBLY

This is a continuation of U.S. patent application Ser. No. 08/071,889, filed Jun. 7, 1993, now abandoned.

BACKGROUND OF THE INVENTION

1. Field of the Invention

The present invention relates generally to electrical connectors and, more specifically, to seal retention for an electrical connector assembly.

2. Description of the Related Art

It is known to provide electrical connectors for connecting a plurality of electrical wires to a printed circuit board. Typically, the electrical connectors have a first connector member and a second connector member which are coupled together. The first connector member has a plurality of pins which pass into the printed circuit board and the second connector member has a plurality of electrical wires for connection with the pins. These electrical connectors are known to use a sealing member as an interface seal for sealing a joint between the coupled connector members. The sealing member is disposed in a recess of one connector member and may have arcuate ribs to contact the other connector member.

One disadvantage of the above electrical connectors is that the recess for the sealing member has a rectangular shape which does not overlap to retain the sealing member. As the connector members are coupled together, the sealing member may tend to roll or twist and be dislodged from the recess. As a result, the sealing member may not provide an adequate seal between the connector members.

SUMMARY OF THE INVENTION

Accordingly, the present invention is an electrical connector assembly including a first connector member, a second connector member, and a sealing means disposed between the first and second connector members for sealing a joint between said first and second connector members. The electrical connector assembly includes means cooperating with one of the first and second connector members to form a cavity for entrapping and positively retaining the sealing means.

One feature of the present invention is that the electrical connector assembly includes a sleeve that cooperates with one of the connector members to form a seal cavity for an interface seal. Another feature of the present invention is that one of the connector members and sleeve partially overlap the interface seal to entrap and retain the interface seal in the seal cavity. Yet another feature of the present invention is that the sleeve provides positive retention of the interface seal, thereby preventing dislodgement of the interface seal. A further advantage of the present invention is that the sleeve provides protection from inadvertent damage to the seal.

Other features and advantages of the present invention will be readily appreciated as the same becomes better understood after reading the subsequent description taken in conjunction with the accompanying drawings.

BRIEF DESCRIPTION OF THE DRAWINGS

FIG. 3 is a sectional view of the electrical connector assembly of FIG. 1.

FIG. 4 is a plan view of a connector member of the electrical connector assembly of FIG. 1.

FIG. 5 is a sectional view taken along line 5—5 of FIG. 4 illustrating pre-assembly of the electrical connector assembly.

FIG. 6 is a view similar to FIG. 4 illustrating post-assembly of the electrical connector assembly.

FIG. 7 is a sectional view of an alternate embodiment of an interface seal, according to the present invention, for the electrical connector assembly of FIG. 1.

DESCRIPTION OF THE PREFERRED EMBODIMENT(S)

Figure 1:
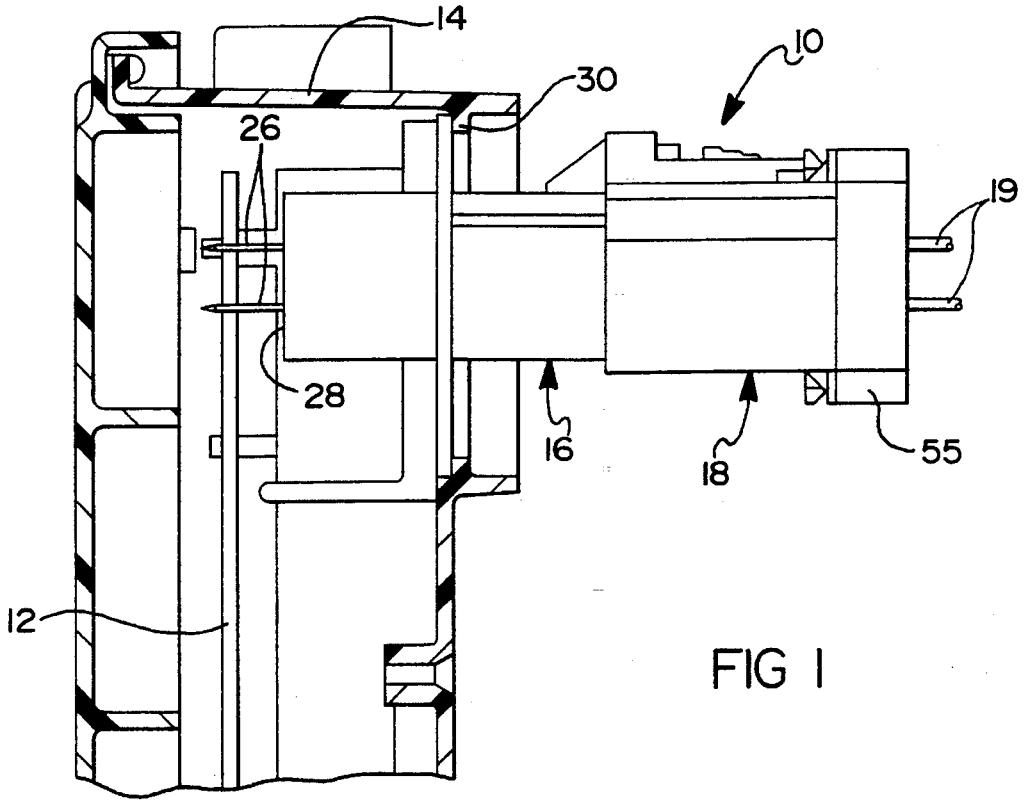
FIG. 1 is an elevational view of an electrical connector assembly, according to the present invention, illustrated in operational relationship with a printed circuit board.

Referring to the drawings and in particular to FIG. 1, an electrical connector assembly 10, according to the present invention, is illustrated in operational relationship with a printed circuit board 12 such as, for example, in a brake control module 14 for an automotive vehicle (not shown). The electrical connector assembly 10 includes a first connector member, generally indicated at 16, and a second connector member, generally indicated at 18, which mate or couple together to provide an electrical connection between a plurality of electrical wires 19 and the printed circuit board 12.

Figure 2:
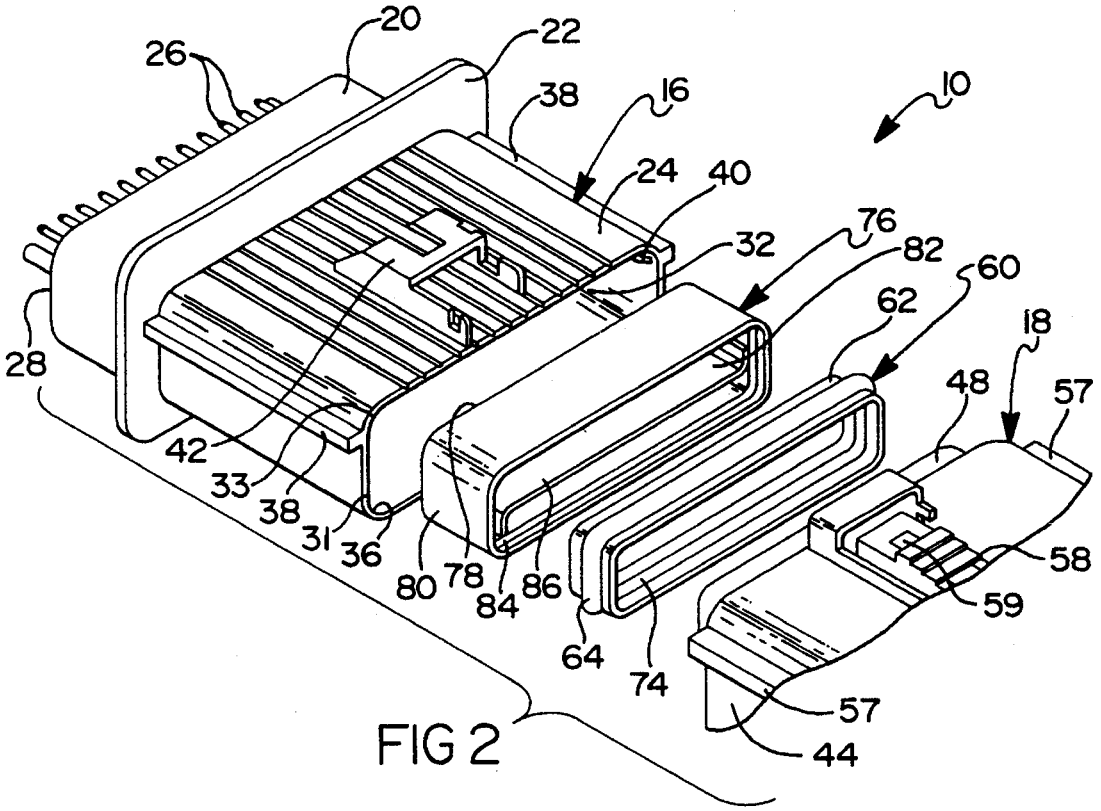
FIG. 2 is an exploded perspective view of the electrical connector assembly of FIG. 1.

Referring to FIGS. 1 through 3, the first connector member 16 extends longitudinally and has a base portion 20 at one end. The first connector member 16 also has a flange portion 22 extending radially at one end of the base portion 20. The first connector member 16 further has a connector portion 24 extending longitudinally from the flange portion 22 to the other end of the first connector member 16. It should be appreciated that the base portion 20, flange portion 22 and connector portion 24 are integral and formed as one piece from a plastic material.

The base portion 20 is generally rectangular in shape to form a hollow interior 25. The base portion 20 supports a plurality of connector pins 26 which extend longitudinally from an interior support member 27 within the hollow interior 25 of the base portion 20. The connector pins 26 pass through corresponding apertures in the printed circuit board 12. The base portion 20 may include an end cap 28 to close the hollow interior 25. It should also be appreciated that the connector pins 26 extend through corresponding apertures in the end cap 28.

Referring to FIGS. 2 through 4, the flange portion 22 is also generally rectangular in shape. The flange portion 22 may include at least one ear portion 29 extending radially outwardly and having an aperture 29*a* extending therethrough. As illustrated in FIGS. 1 and 3, the flange portion 22 may be disposed beneath a flange 30 of the brake control module 14 such that the connector portion 24 extends outwardly of the brake control module 14. The flange portion 22 may be secured to the brake control module 14 by suitable means such as a fastener (not shown) which extends through the aperture 29*a*.

The connector portion 24 has a wall 31 which is generally rectangular in shape to form a hollow interior or cavity 32 having an opening 33. The connector pins 26 extend through apertures 34 in the interior support member 27 and into the cavity 32. The connector portion 24 also includes a lead edge 36 at the opening 33 of the cavity 32. The lead edge 36 is feathered or beveled at an angle of approximately twenty-six degrees (26° ) for a function to be described.

The connector portion 24 also has, at least one, preferably a pair of guide members 38 spaced from each other and extending longitudinally along an outer surface of the wall 31. The guide members 38 are generally rectangular in shape and integral with the wall 31 of the connector portion 24. The connector portion 24 also includes a pressure relief vent or groove 40 extending longitudinally along an interior surface of the wall 31 opposite each guide member 38. The pressure relief groove 40 is generally rectangular in shape and has a predetermined width such as 0.5 mm. Preferably, the width of the pressure relief groove 40 is less than a width of the guide member 38. The pressure relief groove 40 extends longitudinally from one end of the lead edge 36 a predetermined distance beginning 2.0 mm from the lead edge 36 and extending to 6.0 mm for a function to be described. The connector portion 24 further includes a first locking member 42 having a projection 43 disposed along one side of the outer surface of the wall 31 for a function to be described.

Referring to FIGS. 2 through 5, the second connector member 18 has a wall 44 which is generally rectangular in shape to form a hollow interior or first cavity 46. The second connector member 18 also has a center support wall 48 disposed in the first cavity 46 which is generally rectangular in shape and has, at least one, preferably a plurality of passageways 49 extending longitudinally therethrough. The connector member 18 further has a secondary wall 50 disposed in the first cavity 46 with an end portion connected to the wall 44. The secondary wall 50 is generally rectangular in shape and surrounds the support wall 48. The secondary wall 50 extends longitudinally parallel to the support wall 48. The secondary wall 50 is connected to the support wall 48 via a connecting wall 52 to form a seal recess 54 for a function to be described.

The second connector member 18 includes a grommet 55 and an end cap 56 connected to a rear portion of the secondary wall 50 to close the end of the second connector member 18. The end cap 55 has a plurality of apertures 56*a* for allowing the electrical wires 19 to extend into the passageways 49 for connection to the connector pins 26. It should be appreciated that the support wall 48, secondary wall 50 and connecting wall 52 are integral and formed as one piece from a plastic material.

The second connector member 18 also has a pair of channel members 57 spaced from each other and extending along an outer surface of the wall 44. The channel members 57 are generally rectangular in shape and integral with the wall 44 to form channels (not shown) to receive the guide members 38 of the first connector member 16. The second connector member 18 also includes a second locking member 58 disposed on one side of an outer surface of the wall 44 and having a locking aperture 59 to cooperate with the projection 43 on the first locking member 42. The second locking member 58 is attached to the outer surface of the wall 44 in a cantilevered manner and may be deflected toward the wall 44 to allow the locking aperture 59 to engage and disengage the projection 43 on the first locking member 42.

The electrical connector assembly 10 also includes an interface seal, according to the present invention and generally indicated at 60. The interface seal 60 has a base portion 62 extending longitudinally and annularly to form a generally rectangular shape. It should be appreciated that the interface seal 60 may have any suitable shape such as circular to match the shape of the connector members.

The interface seal 60 also has at least one bump or rib portion 64 extending radially from the base portion 62 and annularly therealong. The rib portion 64 has an arcuate apex surface 66 with inclined side surfaces 68 extending outwardly to the base portion 62 to form an outer or peripheral surface having a generally bell shape. The base portion 62 has a lower surface 70 which is generally planar or flat to contact the support wall 48. The base portion 62 also has an upper surface 72 which is inclined toward the arcuate apex surface 66 of the rib portion 64 to intersect the inclined side surface 68 of the rib portion 64.

The interface seal 60 further has at least one cavity 74 extending radially into the base portion 62 from the lower surface 70. The cavity 74 extends longitudinally and annularly along the base portion 62. The cavity 74 allows the base portion 62 to move or displace longitudinally as a result of a displacive force applied to the rib portion 64 as illustrated in FIGS. 5 and 6.

The interface seal 60 is made of an elastomer material such as a soft, inherently lubricated, silicone elastomer having a durometer of fifteen (15) to thirty-five (35) Shore A, preferably eighteen (18) Shore A. The interface seal 60 has an inner periphery three (3) to four (4) percent less than an outer periphery of the support wall 48. The interface seal 60 is disposed about the support wall 48 and positioned therealong such that one end of the base portion 60 is disposed in the seal recess 54.

The electrical connector assembly 10 further includes a sleeve, according to the present invention and generally indicated at 76. The sleeve 76 has an end wall 78 which is generally planar and rectangular in shape. The end wall 78 has a plurality of apertures 79 extending therethrough to receive the connector pins 26. The sleeve 76 also has a side wall 80 extending longitudinally from the end wall 78 to form a generally rectangular hollow interior or cavity 82. The side wall 80 has a seal recess 84 extending longitudinally and radially a predetermined distance from a free end thereof and is generally rectangularly in shape. The sleeve 76 also includes a locating member 86 extending longitudinally from an inner surface of the end wall 78 and into a cavity 88 of the support wall 48. The locating member 86 is disposed in the cavity 88 to locate the sleeve 76 relative to the support wall 48. The seal recess 84, support wall 48 and seal recess 54 cooperate to form a seal cavity 90 for the interface seal 60. The seal cavity 90 has a predetermined width greater than a predetermined width of the base portion 62 of the interface seal 60. For example, the seal cavity 90 may have a predetermined width of 8.0 mm and the base portion may have a predetermined width of 7.0 mm to allow for radial displacement or movement of the rib portion 64 and longitudinal displacement or movement of the base portion 62. It should be appreciated that the seal cavity 90 allows for displacement or movement of the interface seal 60 and the sleeve 76 entraps the interface seal 60, thereby providing positive retention of the interface seal 60.

Referring to FIG. 7, an alternate embodiment 160 of the interface seal 60 is shown. Like parts of the interface seal 60 have like reference numerals increased by one hundred (100). The interface seal 160 has a pair of the rib portions 164 connected to the base portion 162. The interface seal 160 also has a cavity 174 in the base portion 162 opposite each rib portion 164. The operation of the interface seal 160 is similar to the operation of the interface seal 60 to be described. It should be appreciated that the interface seal 160 may have more than two rib portions 164 and cavities 174 as required.

In operation, the interface seal 60 is disposed over the support wall 48 such that the lower surface 70 contacts the outer surface of the support wall 48 and is moved longitudinally such that one end of the base portion 62 is disposed in the seal cavity 54. The connecting wall 52 acts as a stop to locate the interface seal 60 and prevent further longitudinal movement toward the end cap 56. The sleeve 76 is disposed over the support wall 48 such that the locating member 86 is disposed in the cavity 88 of the support wall 48 and moved longitudinally until stopped by engagement between the end of the support wall 48 and the end wall 78. In this position, the other longitudinal end of the base portion 62 of the interface seal 60 is disposed in the seal recess 84. As illustrated in FIG. 5, the interface seal 60 is disposed in the seal cavity 90 with the longitudinal ends of the base portion 62 in the seal recesses 54 and 84 and the rib portion 64 extending radially past an outer surface of the secondary wall 50 and sleeve 76 in a pre-assembled state. The sleeve 76 acts as a stop to prevent longitudinal movement past the seal recess 84, and precludes rolling or twisting of the interface seal 60.

Next, the guide members 38 are orientated and disposed in the channel members 57. The first and second connector members 16 and 18 are moved longitudinally toward each other as illustrated in FIG. 5. The lead edge 36 tangentially contacts or engages the rib portion 64 of the interface seal 60 to apply a displacive force to the rib portion 64 to move radially the rib portion 64 toward the support wall 48. The lead edge 36 provides generally equal radial and longitudinal forces on the interface seal 60 to prevent the interface seal 60 from being dislodged from the seal cavity 90. As the wall 31 moves longitudinally and the rib portion 64 moves radially, the base portion 62 moves longitudinally to fill the space longitudinally in the seal cavity 90. Once this occurs, the rib portion 64 continues to move radially until it bottoms out and then deforms longitudinally as illustrated in FIG. 6.

As illustrated in FIG. 5, when the lead edge 36 contacts the interface seal 60, an initial volume of gaseous fluid such as air is trapped in the cavity 32 between the first and second connector members 16 and 18. As the wall 31 moves longitudinally over the rib portion 64, air trapped in the cavity 32 of the first connector member 16 is allowed to exit or escape through the pressure relief grooves 40. As illustrated in FIG. 6, the pressure relief groove 40 terminates longitudinally at the other side of the rib portion 64 to prevent contaminants such as fluid from entering past the interface seal 60 and into the cavity 32 of the first connector member 16. In this position, the electrical connector assembly 10 is in a post-assembly state with the projection 43 on the first locking member 42 disposed through the aperture 59 of the second locking member 58.

When the electrical connector assembly 10 is to be disconnected, the second locking member 58 is deflected downwardly toward the wall 44 such that the aperture 59 disengages the projection 43. The first and second connector members 16 and 18 are moved longitudinally away from each other. As this occurs, the pressure relief grooves 40 allow air to flow into the cavity 32 to reduce the disengagement force by limiting a vacuum or suction holding the connector members 16 and 18 together. Also, the rib portion 64 relaxes as a result of the displacive force being removed. Due to the cavity 74, the base portion 62 acts as a leaf spring and moves longitudinally and the rib portion 64 moves radially away from the support wall 48 to return to its original position. The sleeve 76 stops the interface seal 60 from longitudinal movement and prevents dislodgement of the seal 60 from the seal cavity 90.

Accordingly, the sleeve 76 has the seal recess 84 that cooperates with the support wall 48 and the seal recess 54 in the second connector member 18 to form the seal cavity 90. The secondary wall 50 and side wall 80 partially overlap the base portion 62 of the interface seal 60 to prevent dislodgement of the interface seal 60 from the seal cavity 90. The sleeve 76 provides positive retention of the interface seal 60 in the seal cavity 90 by preventing longitudinal movement past the seal recess 84. The seal recesses 54 and 84 entrap the interface seal 60 and allow for longitudinal displacement or movement of the base portion 62, thereby protecting the interface seal 60 from inadvertent damage.

The present invention has been described in an illustrative manner. It is to be understood that the terminology which has been used is intended to be in the nature or words of description rather than of limitation.

Many modifications and variations of the present invention are possible in light of the above teachings. Therefore, within the scope of the appended claims, the present invention may be practiced other than as specifically described.

What is claimed is:

1. An electrical connector assembly comprising:

a first connector member;

a second connector member;

sealing means disposed between said first and second connector members; and sleeve means disposed over a portion of one of said first and second connector members and partially overlapping said sealing means for cooperating with the one of said first and second connector members to form a cavity having a longitudinal width greater than a radial height thereof and an opening with a longitudinal width less than a longitudinal width thereof for entrapping and positively retaining said sealing means on the one of said first and second connector members.

2. An electrical connector assembly as set forth in claim 1 wherein said cavity has a predetermined longitudinal width.

3. An electrical connector assembly as set forth in claim 1 wherein said cavity has a longitudinal width greater than a longitudinal width of said sealing means.

4. An electrical connector assembly as set forth in claim 1 wherein the one of said first and second connector members has a first seal recess extending longitudinally, said sealing means being partially disposed in said first seal recess.

5. An electrical connector assembly as set forth in claim 4 wherein said sleeve means comprising a sleeve disposed about the one of said first and second connector members and having a second seal recess extending longitudinally, said sealing means being partially disposed in said second seal recess.

6. An electrical connector assembly as set forth in claim 1 wherein said sealing means comprises an interface seal having a base portion extending longitudinally and annularly and at least one rib portion extending radially from said base portion and annularly therealong.

7. An electrical connector assembly as set forth in claim 6 wherein the one of said first and second connector members has a support wall, a secondary wall spaced radially from and extending longitudinally parallel to said support wall, and a connecting wall interconnecting said support wall and said secondary wall to form a first seal recess.

8. An electrical connector assembly as set forth in claim 7 wherein said base portion has a lower surface contacting said support wall and said base portion being partially disposed in said first seal recess and overlapped by said secondary wall.

9. An electrical connector assembly as set forth in claim 8 wherein said sleeve means comprises a sleeve disposed over said support wall.

10. An electrical connector assembly as set forth in claim 9 wherein said sleeve has an end wall which abuts an end of said support wall and a side wall extending longitudinally from said end wall.

11. An electrical connector assembly as set forth in claim 10, wherein said side wall has a second seal recess extending longitudinally into a free end thereof, said base portion being partially disposed in said second seal recess and overlapped by said side wall.

12. An electrical connector assembly comprising:

a first connector member;

a second connector member;

an interface seal disposed between said first and second connector members;

a sleeve disposed over a portion of one of said first and second connector members and partially overlapping said interface seal for cooperating with the one of said first and second connector members to form a cavity having a longitudinal width greater than a radial height thereof and an opening with a longitudinal width less than a longitudinal width thereof for entrapping and positively retaining said interface seal on the one of said first and second connector members;

the one of said first and second connector members having a first seal recess extending longitudinally;

said sleeve having a second seal recess extending longitudinally, said interface seal being partially disposed in said first and second seal recess.

13. An electrical connector assembly as set forth in claim 12 wherein said cavity is formed by said first and second seal recess and has a longitudinal width greater than a longitudinal width of said interface seal.

14. An electrical connector assembly as set forth in claim 12 wherein said interface seal has a base portion extending longitudinally and annularly and at least one rib portion extending radially from said base portion and annularly therealong.

15. An electrical connector assembly as set forth in claim 14 wherein the one of said first and second connector members has a support wall, a secondary wall spaced radially from and extending longitudinally parallel to said support wall, and a connecting wall interconnecting said support wall and said secondary wall to form said first seal recess.

16. An electrical connector assembly as set forth in claim 15 wherein said base portion has a lower surface contacting said support wall and said base portion being partially disposed in said first seal recess and overlapped by said secondary wall.

17. An electrical connector assembly as set forth in claim 16 wherein said sleeve has an end wall which abuts an end of said support wall and a side wall extending longitudinally from said end wall, wherein said side wall has said second seal recess extending longitudinally into a free end thereof, said base portion being partially disposed in said second seal recess and overlapped by said side wall.

18. An electrical connector assembly comprising:

a first connector member;

a second connector member;

an interface seal disposed between said first and second connector members, said interface seal having a base portion extending longitudinally and annularly and at least one rib portion extending radially from said base portion and annularly therealong;

the one of said first and second connector members having a support wall, a secondary wall spaced radially from and extending longitudinally parallel to said support wall, and a connecting wall interconnecting said support wall and said secondary wall to form a first seal recess;

said base portion having a lower surface contacting said support wall and said base portion being partially disposed in said first seal recess and overlapped by said secondary wall;

a sleeve disposed over said support wall, and having an end wall which abuts an end of said support wall and a side wall extending longitudinally from said end wall;

said side wall having a second seal recess extending longitudinally into a free end thereof, said base portion being partially disposed in said second seal recess and overlapped by said side wall.

* * * * *